United States Patent [19]

Schofield

[11] Patent Number: 4,770,095

[45] Date of Patent: Sep. 13, 1988

[54] SQUEEZE ROLL AND ACTUATOR ASSEMBLY UTILIZING INFLATABLE BAGS

[76] Inventor: Robert C. Schofield, 5520 Melton Rd., Portage, Ind. 46368

[21] Appl. No.: 86,281

[22] Filed: Aug. 17, 1987

[51] Int. Cl.[4] ..... B30B 1/00; B30B 1/38

[52] U.S. Cl. ..... 100/170; 100/269 A; 100/214; 254/93 HP

[58] Field of Search ..... 100/176, 170, 269 A, 100/214; 254/93 HP; 425/389, 390; 83/639; 269/22; 29/113 R

[56] References Cited

U.S. PATENT DOCUMENTS

| | | | |
|---|---|---|---|
| 2,596,154 | 3/1952 | Keating et al. | 100/176 X |
| 3,209,679 | 10/1965 | Crist et al. | 100/170 |
| 3,376,808 | 4/1968 | Beckett et al. | 100/269 A |
| 3,703,842 | 11/1972 | Yarlott et al. | 100/269 A |
| 3,765,322 | 10/1973 | Weyer | 100/269 A |

*Primary Examiner*—Andrew M. Falik

*Attorney, Agent, or Firm*—Burmeister, York, Palmatier, Hamby & Jones

[57] ABSTRACT

A differential pressure actuator includes two fluid containing bags mounted on opposite sides of a support bar, and one of the bags is coupled to a load by means of a plate at the side of the bag opposite the bar. The other bag is also coupled to the load by means of a second plate mounted at the opposite end of the other bag, and the second plate is mechanically connected to the first plate by rods. Both of the bags contained a pressurized fluid in excess of atmospheric pressure, and the difference in the forces generated by the two bags is impressed upon the load. The load is a movable roller in a ringer for coating steel, and the movable roller is provided with separate actuators at opposite ends of the roller.

7 Claims, 2 Drawing Sheets

2.
78
82
90
84
74
76
46
48
27
52
50
54
96
26
68
22
28
42
70
62
72
30
32
18
16
20B
12
34
36
44
40
38
20A
10

3.
116
45A
112
80
74
46
26
32
45B
50
68
70
42
72
20B
18
12
16
10
44
38
20A
34
30
14
24
22

SQUEEZE ROLL AND ACTUATOR ASSEMBLY UTILIZING INFLATABLE BAGS

The present invention relates to devices in which sheet material is passed between a pair of abutting rolls, particularly squeeze rolls or wringers. The invention has particular utility in wringers for use in producing coated sheet steel.

BACKGROUND OF INVENTION

There are many occasions in which a sheet of material is passed between a pair of abutting rolls. Generally, the rolls are disposed horizontally, with one roll directly above the other roll, and one of the rolls, generally the lower roll, is maintained in a stationary position. The upper roll is urged into abutment with the lower roll, but will deflect upwardly to permit sheet material to pass between the rolls. The rolls may be powered to facilitate transport of the material, or the rolls may be utilized to control movement of the material. In some processes for coating sheet material, the rolls are utilized as wringers to wring excess cleaning and coating material from the sheet.

In the production of coated sheet material, the cleaning and squeezing of the coatings or solutions on sheet material has a significant effect upon the quality of the final product. The sheet metal itself, prior to coating, has imperfections such as small indentations or protuberances. The protuberances on the metal sheet may cause the rolls of the squeegee or wringers to lose contact with the solutions immediately downstream of the protuberance resulting in an imperfection in the coating of the sheet metal. It is one of the objects of the present invention to provide a roll assembly with a pressure actuator which minimizes imperfections in coatings applied to elongated strips of sheet material.

The inventor has found that imperfections in the applied solutions on sheet metal can be greatly reduced by adjusting the pressure exerted between the wringer rolls to an optimum value and maintaining that pressure. It is known that the application and removal of the coating or solutions that remain on the sheet metal after passing the wringer depends upon the pressure exerted on the sheet produced by the rolls. Conventional equipment utilized to remove solutions from sheet metal at the present time employs pneumatic cylinders to force the rolls toward each other and to place pressure on the sheet metal as it passes through the wringer. The inventor believes that protuberances in the sheet metal and solutions being removed force the rolls of the wringer apart, and in conventional equipment utilizing pneumatic cylinders, the movement of one roll with respect to the other results in translation of the piston with the air cylinder and an increase in the pressure within the air cylinder.

The force exerted by the air cylinder immediately following the passage of a protuberance on the sheet metal or solutions being wrung by the wringers is believed to result in a region in which the solutions are not removed or is uneven. Further, it often requires a period of time following a protuberance or solution passing between the rolls for the air cylinder to reach stabilization, resulting in hunting by the air cylinder, and such hunting produces an uneven layer of coating on the sheet metal. It is thus an object of the present invention to provide a roll assembly suitable for use as a squeegee or wringer with an improved actuator for controlling the pressure between the rolls.

Efforts have been made in the past to provide an improved actuator for use with squeeze rolls or wringers for use in the treatment of cloth, and U.S. Pat. No. 2,758,466 entitled SQUEEZE ROLL by Harold H. Belcher discloses an actuator for this purpose. The actuator of Belcher is a modified form of pneumatic cylinder in which membranes are utilized for seals.

In the past there have been many mechanical breakdowns for coating production lines as a result of failure of the actuator mechanism used to apply pressure to the squeeze rolls. The squeeze rolls operate in approximately the same range at all times, causing the piston of a pneumatic cylinder to move slightly with respect to a fixed position, thereby concentrating wear on the rings of the piston. As a result, pneumatic cylinders tend to fail when used as actuators for a wringer, resulting in disruption of production. It is a further object of the present invention to provide an actuator mechanism which is capable of long use in a wringer assembly without mechanical failure.

In past constructions, compliance in the linkage between the air cylinder and the movable roll have been a source of imperfection in coated or treated sheet. Compliance in the linkage has resulted in hunting or excessive snap-back pressure following the passing of a protuberance or solution in the sheet material. It is an object of the present invention to eliminate as far as possible linkage between the actuator and movable roll to avoid such sources of imperfections in the product.

SUMMARY OF THE INVENTION

In its broader aspects, the present invention contemplates a roll assembly in which there is a stationary roll and an aligned movable roll positioned by an actuator mechanism which utilizes a bag inflated with any liquid, or gaseous, or combination, medium, such as an air bag. The length of the unloaded air bag as measured between opposite ends is a direct function of the pressure within the bag. The air bag is pressurized to elongate the bag to provide the desired location and pressure between the rolls of the roll assembly. The pressure is maintained at this level, either by sealing the air bag or by providing a constant pressure source. Sheet material transported between the rolls of the assembly will cause the movable roll to deflect in response to protuberances in the sheet material, or materials on the sheet, thus changing the length of the air bag and the volume of the air bag. The air bag has resilient flexible walls, and compression of the air within the air bag results in expansion of the volume of the air bag, thus compensating for a decrease in the length of the air bag and an increase in air pressure within the air bag. In a preferred construction, the air bag directly actuates the bearing block of the movable roller, thereby assuring control of the pressure on the rolls by the actuator and minimizing hunting.

In a preferred construction, a second air bag is utilized in a differential construction. Movement of the movable roll with respect to the stationary roll in one direction compressing the first air bag and elongating the second air bag. Elongation of the second air bag increases the volume of the second air bag and reduces the air pressure within that bag, but this reduction is offset by the resiliency of the walls of the second air bag, thereby maintaining a more constant pressure in the second air bag and a more constant force on the movable roll from the second air bag. The force exerted on the movable roll is the difference between the forces exerted by the first and second air bags, thereby providing precise force control in response to the pressure of the air within the first and second air bags. In addition, the use of two air bags in a differential arrangement permits higher air pressure to be utilized in the air bags than desirable for establishing the proper pressure on the rolls. The air pressure selected for the air bags may thus be determined by the deflection/pressure curve for a given air bag in order to assure a minimum pressure change within the air bag responsive to a deflection of a roll caused by the nonuniformity of the sheet material being transported by the rolls. The use of two air bags in a differential arrangement permits either positive or negative pressure adjustment to the weight of the roll.

DESCRIPTION OF THE DRAWINGS

For a more complete understanding of the present invention, a specific embodiment of the invention is set forth hereinafter and in the accompanying drawings, in which.

DETAILED DESCRIPTION OF THE INVENTION

Figure 2:
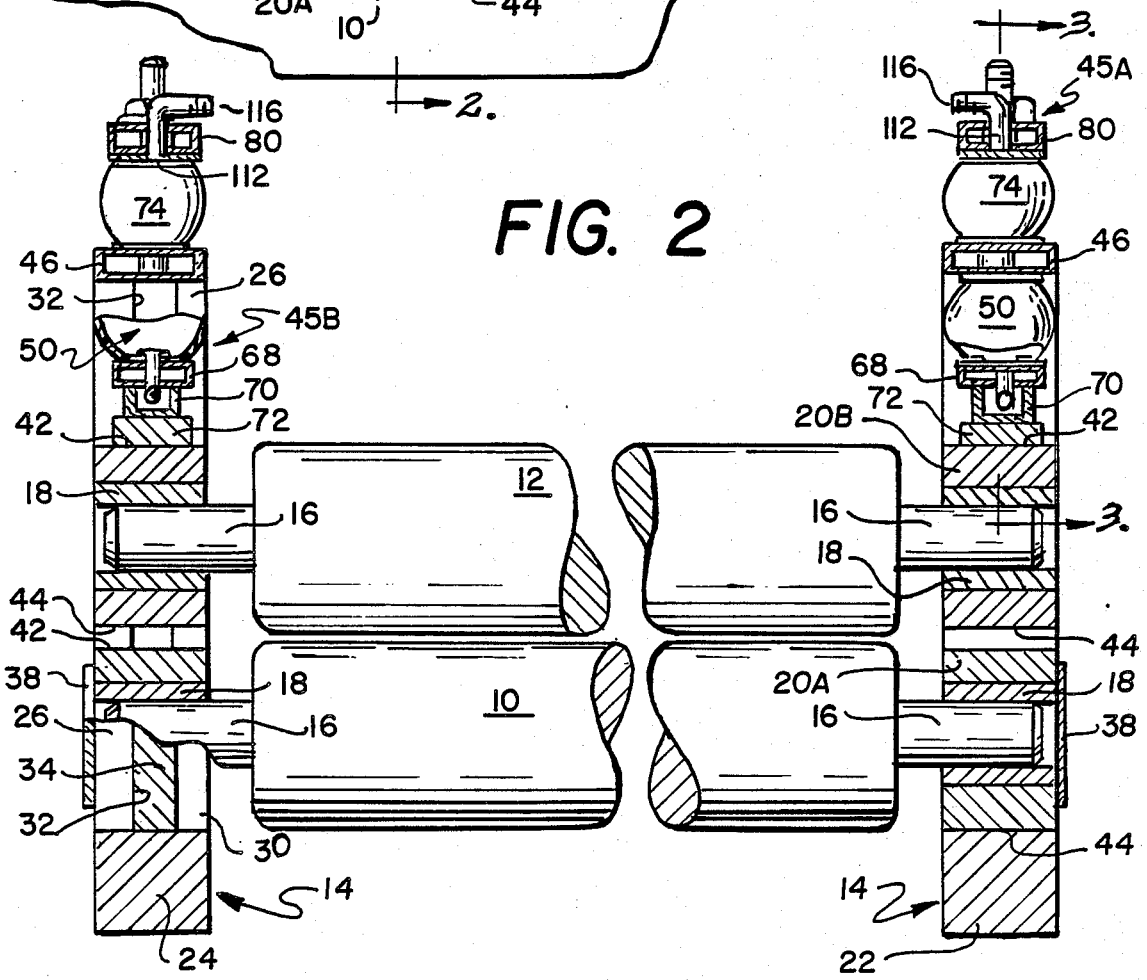
FIG. 2 is a sectional view of the roller and actuator assembly taken along the line 2—2 of FIG. 1.

As illustrated in FIG. 2, a pair of rolls 10 and 12 are horizontally mounted on a support structure 14. The rolls 10 and 12 are cylindrical, of the same diameter, and constructed of steel. Each of the rolls 10 and 12 has stems 16 outwardly extending from opposite ends thereof, and the stems are journaled within bearings 18 carried by bearing blocks 20A and 20B, respectively.

The support structure 14 has two walls 22 and 24 disposed parallel to each other, and the walls 22 and 24 are each provided with a recess 26 extending therein from the top 27 of the wall 22 or 24. Each of the recesses 26 is provided with opposing vertical parallel sides 28 and 30, and the sides 28 and 30 are each provided with an elongated slot 32 which extends therein to form a keyway. The bearing blocks 20A and 20B have flanges 34 and 36 extending outwardly therefrom on opposite sides which are translatably disposed within the slots 32 of the sides 28 and 30 of the recess 26, thereby making the bearing blocks 20A and 20B translatable within the recess 26. The bearing blocks 20A of the roll 10 however are anchored on the walls 22 and 24 by plates 28 and 40 mounted on the walls 22 and 24 and secured to the bearing blocks 20A of the roll 10. Hence, the roll 10 is anchored on the support structure 22 and is the stationary roll.

The bearing blocks 20A and 20B are identical, and are provided with an upper surface 42 and a lower surface 44, the surfaces 42 and 44 being normal to the sides 28 and 30 of the recess 26 and horizontal. When the rolls 10 and 12 are in abutment, significant space exists between the upper surface 42 of the movable bearing blocks 20B and the top 27 of the wall 22 and wall 24, and actuator mechanisms 45A or 45B are disposed in these regions, respectively.

Each of the actuator mechanisms 45A and 45B has a rectangular elongated support tube or bar 46 which is mounted on the top 27 of the wall 22 or 24 in an indentation 48 thereof, and the tube 46 extends horizontally across the recess 26. A first air bag 50 is mounted on the lower side of the tube 46 and extends downwardly toward the bearing block 20B. The air bag has two opposed ends 52 and 54, the end 52 being mounted on the lower side of the tube 46. A resilient flexible wall 56 extends from the end 52 to the end 54 and forms a sealed chamber 58. A stem 60 extends outwardly from the chamber through the bottom end 54 of the air bag 50, and has a valve 62 at one end. A compressed air source is either permanently or temporarily connected to the stem 60 to pressurize the chamber 58 and inflate the air bag 50 to a desired pressure, inflation of the air bag causing the ends 52 and 54 to become displaced further from each other. In the construction illustrated, the ends 52 and 54 of the air bag are at all times too close to each other to provide optimum geometry for the chamber 58 so that any shortening of the distance between the ends 52 and 54 decreases the volume of the chamber 58 and increases the pressure of the air within that chamber.

The ends 52 and 54 of the air bag 50 are provided with flanges 64 and 66 for mounting purposes, the flange 64 being mounted on the underside of the tube 46, and the flange 66 being mounted on a flat plate 68. The plate 68 extends outwardly from opposite sides of the air bag 50 and is directly coupled to the upper surface 42 of the bearing block 20B by a U-shaped bracket 70 and a spacer bar 72. The pressure of the air within the chamber 58 of the air bag 50 thus generates pressure between the tube 46 and the bearing block 20B.

Separate actuator assemblies 45A and 45B of identical construction are mounted on the walls 22 and 24 and exert pressure on the bearing blocks 20B at opposite ends of the movable roll 12 to force that roll toward the stationary roll 10.

The air bag 50 itself is a well known commercial product available from Firestone Industrial Products Company of Nobelsville, Ind. The graph in FIG. 4 illustrates the typical operating conditions of the air bag in the application illustrated in FIGS. 1 through 3.

Figure 4:
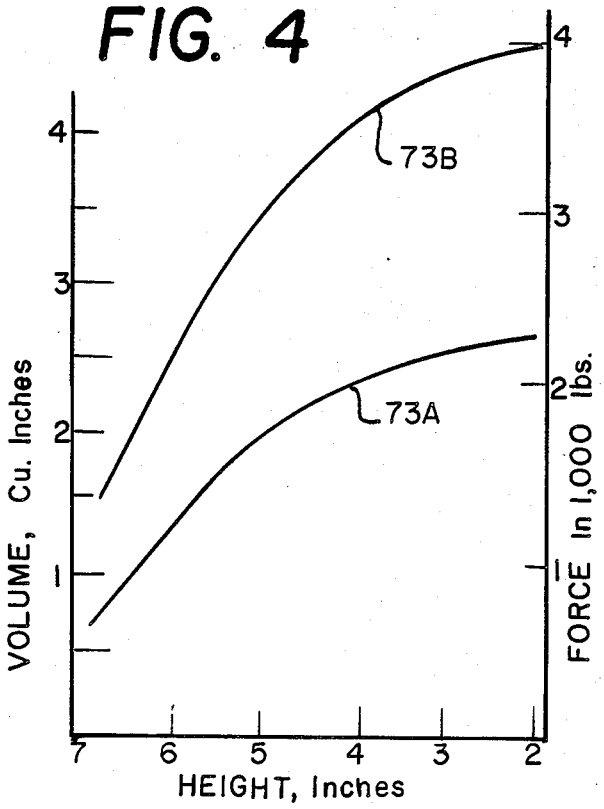
FIG. 4 is a graph illustrating the change in volume with respect to a change in height of one of the air bags at fixed pressure.

As illustrated in FIG. 4, for a given air pressure, the air bag 50 will have a relatively small change in volume when the height or distance between the ends 52 and 54 changes in the range at the far right of the graph, namely 2 to 3 inches, but the change in volume accelerates when the height in inches is greater. Since the volume change determines the pressure change within the air bag 50, it is usually desirable to operate the air bag in a region where the curve is relatively flat, namely at the upper right portion of the curve. The shape of the curve is determined by the geometry of the air bag and the flexibility of the air bag walls. FIG. 4 illustrates two curves 73A and 73B operating at different pressures. The lower curve 73A is flatter but is for a lower pressure. The upper curve 73B provides much greater force.

The structure of the actuators 45A and 45B described to this point is effective to control the roll 12 with respect to the roll 10. However, the complete structure illustrated in the figures provides more accurate adjustment of the force on roll 12 with respect to roll 10 and limits the permissible movement of roll 12 with respect to roll 10. In addition, it permits the air bag 50 to be operated at higher pressure.

Figure 1:
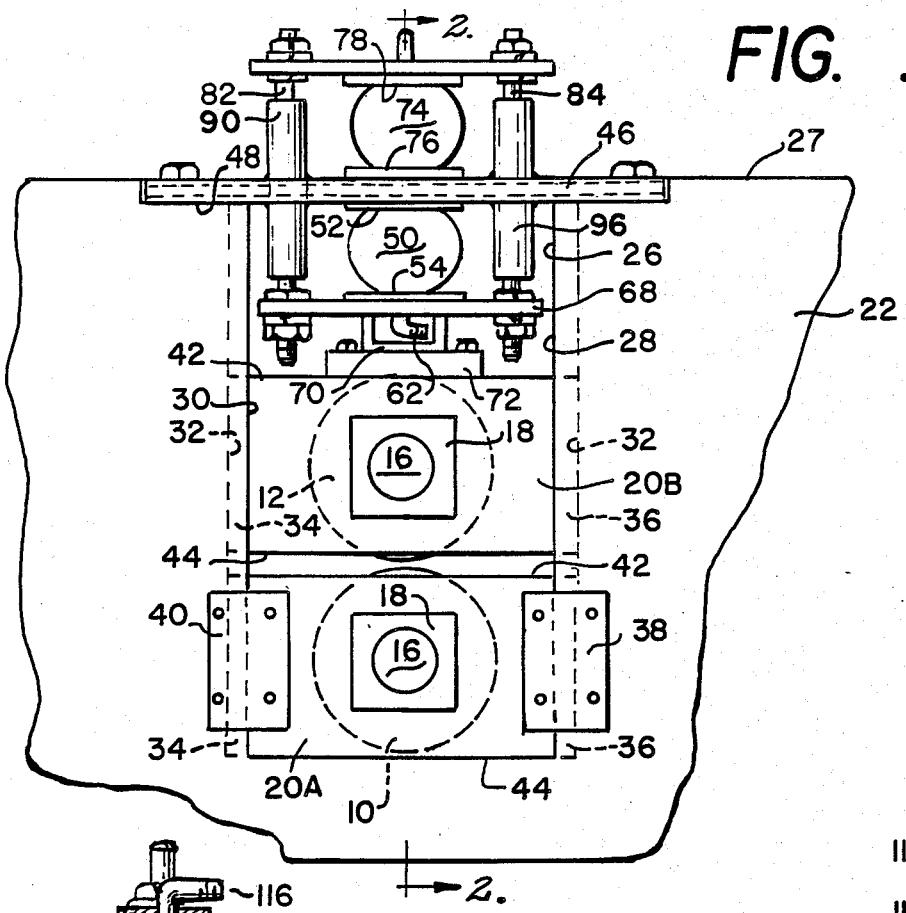
FIG. 1 is a side elevational view of a roller assembly and actuator constructed according to the teachings of the present invention, the reverse side being a mirror image thereof.
Figure 3:
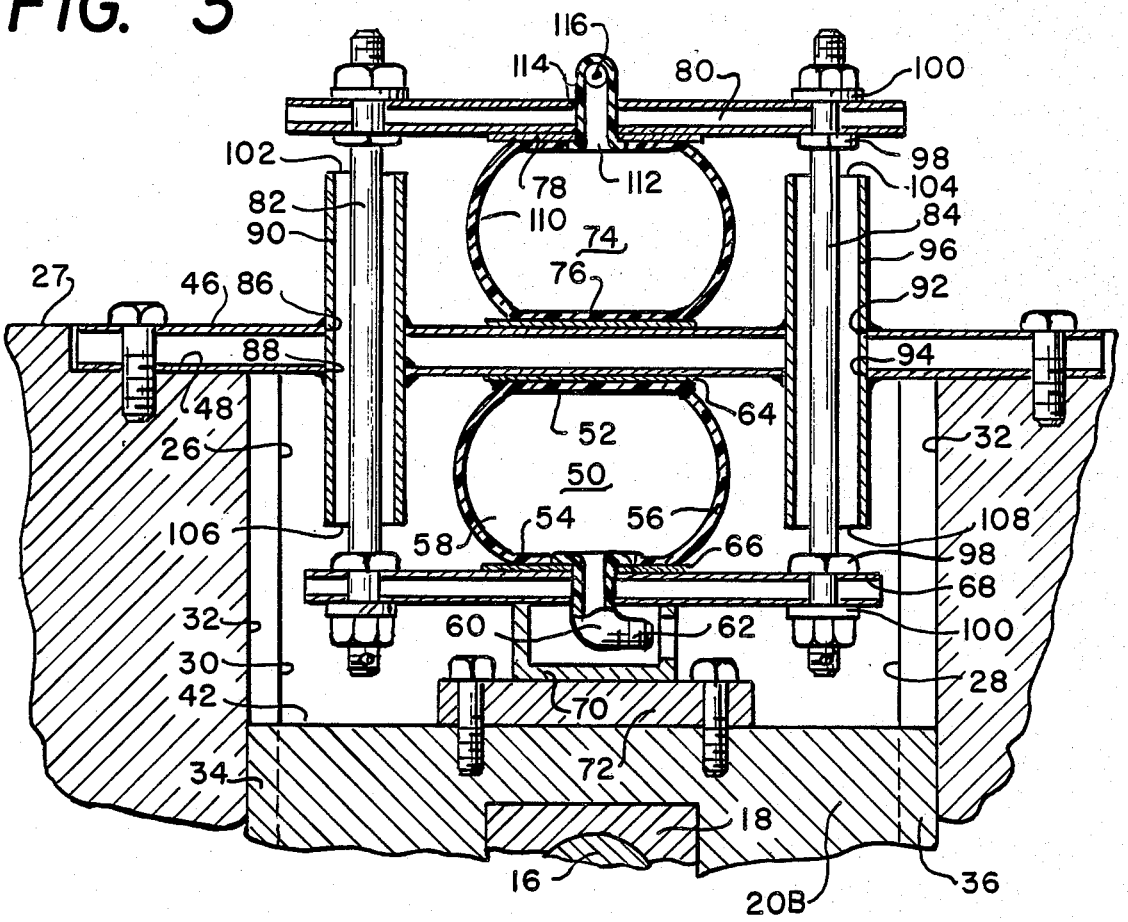
FIG. 3 is a fragmentary sectional view taken along the line 3—3 of FIG. 2.

As illustrated in FIGS. 1 through 3, a second air bag 74 is mounted on the upper side of the tube 46 and extends upwardly therefrom, the second air bag 74 having one end 76 mounted on the upper side of the tube 46. The opposite end 78 of the second air bag 74 is mounted on a second plate 80 which is generally parallel to the tube 46. A pair of posts 82 and 84 are mounted at one end thereof on the plate 80 at opposite ends thereof, and the opposite ends of the posts 82 and 84 are mounted adjacent to the opposite ends of the plate 68. The post 82 extends through apertures 86 and 88 in the walls of the tube 46, and a sleeve 90 surrounds the post 82, passes through the apertures 86 and 88 and is welded or otherwise secured on the tube 46 at the apertures. In like manner, the post 84 extends through apertures 92 and 94 in the tube 46, and a sleeve 96 extends through the apertures 92 and 94 and is secured thereon.

The posts 82 and 84 are freely translatable within the sleeves 90 and 96. As illustrated in the figures, the posts 82 and 84 are anchored on the plates 68 and 80 by lock nuts 98 and 100, but the posts may be secured in any manner. The tubes 90 and 96 have upper ends 102 spaced from the plate 80, and lower ends 106 and 108 spaced from the plate 68, and hence the actuating mechanisms 45A and 45B may drive the roll 12 toward the roll 10 until the plate 80 abuts the ends 102 and 104 of the tubes 90 and 96. In like manner, the actuating mechanisms 45A and 45B may permit the rolls 10 and 12 to move apart until the plate 68 abuts the ends 106 and 108 of the tubes 90 and 96. Sleeves 90 and 96 may be adjusted or shimmed to proper length to limit crushing of the air bag.

The second air bag 74 is constructed with a resilient wall 110 between its ends 76 and 78 and has a valve stem 112 which extends outwardly from the end 78 through an aperture 114 in the plate 80, and an air valve 116 is disposed in the stem structure 112. The wall 110 is a flexible resilient wall, and the air bag 74 is thus constructed in the same manner as the air bag 50, although it is not necessary that the air bags 50 and 74 be an identical pair. The air bag 74 is inflated through the stem 112 and sealed or provided with pressure lines, and the air bag 74 exerts pressure through the plate 80, the posts 82 and 84, the plate 68, the bracket 70 and spacer 72 on the bearing block 20B. The force exerted by the air bag 74 is in the direction opposite to the force exerted by the air bag 50, and hence the resultant of the forces is exerted upon the bearing blocks 20B. FIG. 3 illustrates a typical construction using identical air bags 50 and 74. Assuming both air bags have a height of approximately 4 inches, air bag 50 will produce a force of approximately 3300 pounds while operating at a pressure of 100 pounds per square inch. The air bag 74 operating at a pressure of approximately 40 pounds per square inch will produce a force of approximately 2000 pounds, thus imposing a net force of approximately 1300 pounds on the roller 12. To achieve this force with an air bag 50 operating alone, the air pressure within the bag 50 would have to be significantly lower than 40 pounds per square inch and in an inefficient part of the range of operation for the air bag.

While the actuators 45A and 45B have been illustrated in connection with a squeeze roll particularly adapted for the production of coated sheet metal, the actuator may be used for other purposes as well. However, the actuator has particular utility in connection with control of a squeeze roll due to the constant pressure which the actuator will apply to the roll, the lack of linkage introducing compliance between the actuator and the roll, and the speed with which the actuator will adjust to changes in conditions. In the production of treated or coated sheet metal, the actuators 45A and 45B illustrated in the present application have resulted in greatly improved uniformity of the coating on the sheet metal, great reduction in down time of sheet processing equipment due to failure of the movable roll actuators, reduced power consumption, reduced wear of rolls, and ease of installation and setup of the movable roll actuators.

Those skilled in the art will develop other applications for the actuators here disclosed. It is intended that the scope of the present invention be not limited by the foregoing specification, but rather only by the appended claims.

The invention claimed is:

1. A roll assembly for sheet material comprising a support structure, a first elongated roll having opposite ends, a first means and a second means mounted on the support structure respectively engaging the opposite ends of the first roll for rotatably mounting the first roll in a stationary position with respect to the support structure, a second elongated roll having opposite ends, a third means and a fourth means mounted on the support structure respectively engaging the opposite ends of the second roll for rotatably mounting the second roll with the axis of elongation of the second roll disposed in the same plane as the axis of elongation of the first roll, the third means permitting translation of the second roll in said plane with respect to the first roll, a first means mounted on the support structure and coupled to the third rotatable mounting means for exerting a force on the second roll toward the first roll including a first bag having two spaced ends, one of said ends being anchored in a fixed position on the support structure and the other of the said ends being mechanically coupled to the third mounting means, said first bag having flexible elastic walls extending between the ends thereof and containing a fluid atmosphere at a pressure above atmospheric pressure, and the volume of the first bag being a direct function of the spacing between the ends of the first bag and a direct function of the fluid pressure within the first bag, whereby the insertion of an object between the first and second rolls results in decreasing the volume of the first bag and increasing the pressure of the gaseous atmosphere within the first bag to expand the volume of the first bag and compensate for the increase in pressure in the first bag, a second bag having two spaced ends, one of the ends of the second bag being anchored in a fixed position on the support structure and the other of said ends being mechanically coupled to the third mounting means, the second air bag containing a gaseous atmosphere and exerting a force on the second roll directed oppositely from the force of the first bag and of different magnitude.

2. A roll assembly for sheet material comprising a support structure adapted to be disposed on a horizontal surface, said support structure defining a pair of spaced confronting vertical keyways, a first bearing block mounted in fixed position on the support structure at the lower end of one of the keyways and a second bearing block mounted in a fixed position on the support structure at the lower ends of the pair of keyways, respectively, end of the other of the keyways, and a first elongated roll journaled at opposite ends on the first and second bearing blocks, a third bearing block translatably keyed within the one keyway and a fourth bearing block translatably keyed within the other keyway of the pair of keyways, a second elongated roll journaled at opposite ends on the third and fourth bearing blocks, the second roll being movable with respect to the first roll and the axes of the first and second rolls being disposed in a vertical plane, an actuator having a bar extending across the one keyway of the pair above the third bearing block and mounted on the support structure, said actuator having a first bag having opposite ends and a flexible elastic wall extending between ends thereof, one end of the first bag being mounted in a fixed position on the underside of the bar and extending toward the third bearing block, the other end of the first bag being connected to the third bearing block, a second bag having opposite ends and a flexible elastic wall extending between ends thereof, one end of the second bag being mounted on the upper side of the bar and the second bag extending away from the third bearing block, the other end of the second bag being mechanically coupled to the third bearing block, the first and second bags having a fluid therein at pressures above atmospheric pressure, the volume of the first and second bags being a direct function of the distance between the ends thereof and the fluid pressure within the first and second bags, and the force exerted on the third bearing block by the actuator being the difference in the forces from the first and second bags.

3. A roll assembly for sheet material comprising the combination of claim 2 in combination with a second actuator having a second bar extending across the other keyway of the pair above the fourth bearing block and mounted on the support structure, said second actuator having a third bag having opposite ends and a flexible elastic wall extending between ends, one end of the third bag being mounted in a fixed position on the underside of the second bar and the bag extending downwardly toward the fourth bearing block, and the other end of the third bag being connected to the fourth bearing block, a fourth bag having opposite ends and a flexible elastic wall extending between ends, one end of the fourth bag being mounted on the upper side of the bar and the fourth bag extending away from the fourth bearing block, the other end of the fourth bag being mechanically coupled to the fourth bearing block, the volume of the third and fourth bags being a direct function of the distance between the ends thereof and the gaseous pressure within the third and fourth bags, and the force exerted on the fourth bearing block by the actuator being the difference in the forces from the third and fourth bags.

4. A roll assembly for sheet material comprising the combination of claim 2 wherein the means mechanically coupling the second bag to the third bearing block comprises a first plate mounted on the other end of the first bag and extending outwardly from opposite sides thereof, a second plate mounted on the other end of the second bag and extending outwardly therefrom, a pair of posts mounted on the first plate on opposite sides of the first bag and extending to the second plate, said pair of posts extending on opposite sides of the second bag and being anchored on the second plate, the first plate being attached to the third bearing block.

5. A roll assembly for sheet material comprising the combination of claim 4 wherein each of the posts extends through an aperture in the bar and is translatably surrounded by a sleeve, each sleeve extending through an aperture in the bar and being mounted on the bar, each sleeve extending toward the first plate and terminating at a distance from the first plate to form a stop against upward movement.

6. A differential pressure actuator comprising a support bar having opposite sides, a first and a second bag having opposite ends, one end of the first bag being mounted on one side of the bar and the first bag extending outwardly from the bar, one end of the second bag being mounted on the other side of the bar opposite the first bag and the second bag extending outwardly from the bar, a first plate mounted on the other end of the first bag and extending outwardly from opposite sides of the first bag, a second plate mounted on the other end of the second bag and extending outwardly from opposite sides of the second bag, a pair of posts, each post having one end mounted on the first plate and an opposite end mounted on the second plate, the first and second bags having flexible elastic walls and containing a fluid under pressure in excess of atmospheric pressure, the first bag producing a first force between the bar and the first plate which is a function of the pressure of the fluid in the first bag, and the second bag producing a second force between the bar and the second plate which is a function of the fluid in the second bag, and means coupling the first plate to a load, whereby the force of the actuator impressed on the load is a function of the difference between the first and second forces.

7. A differential pressure actuator comprising the combination of claim 6 wherein the first and second plates are elongated and parallel to each other and the posts extend translatably through a first and a second aperture in the bar, in combination with a first sleeve extending through the first aperture and translatably surrounding the one post, and a second sleeve extending through the second aperture and translatably surrounding the other post, said sleeves being mounted on the bar and extending toward and spaced from the second plate, whereby the sleeves form a stop for movement of the actuator.

* * * * *